United States Patent [19]

Lindsay

[11] 4,448,209

[45] May 15, 1984

[54] WASHER FOR PAINT ROLLERS

[76] Inventor: Erin J. Lindsay, 17855 Sharon Hollow La., Manchester, Mich. 48158

[21] Appl. No.: 359,203

[22] Filed: Mar. 18, 1982

[51] Int. Cl.[3] ..... B08B 3/00

[52] U.S. Cl. ..... 134/141; 134/200

[58] Field of Search ..... 134/141, 138, 139, 149, 134/154, 182, 183, 112, 93, 200, 172, 198; 68/213

[56] References Cited

U.S. PATENT DOCUMENTS

| | | | |
|---|---|---|---|
| 608,871 | 8/1898 | Kirkwood | 134/139 |
| 1,265,390 | 5/1918 | Schmitt | 134/141 |
| 2,151,437 | 3/1939 | Ohme et al. | 134/141 X |
| 2,773,274 | 12/1956 | Beech | 134/149 X |
| 2,968,824 | 1/1961 | Beech | 68/213 |
| 3,306,309 | 2/1967 | Pahl et al. | 134/141 |
| 3,421,527 | 1/1969 | Dettman | 134/138 |
| 3,428,060 | 2/1969 | Spivey | 134/141 |
| 3,818,529 | 6/1974 | Leggett | 134/138 X |
| 4,294,272 | 10/1981 | Kaiber | 134/138 |

FOREIGN PATENT DOCUMENTS

| | | | |
|---|---|---|---|
| 1110077 | 2/1956 | France | 134/157 |

*Primary Examiner*—Stephen Marcus
*Assistant Examiner*—Ernest G. Cusick
*Attorney, Agent, or Firm*—Barnes, Kisselle, Raisch, Choate, Whittemore & Hulbert

[57] ABSTRACT

A washing apparatus for cleaning paint applicators of the roller type in which a housing is provided for resiliently retaining a roller; a washing cylinder is provided for contact with the roller. Water power is utilized to rotate the washing cylinder and also distributes flushing washer to the roller during the rotation cycle. A directional valve can control the water flow to the roller or to the drain for providing a rinsing cycle and a ring cycle.

13 Claims, 7 Drawing Figures

WASHER FOR PAINT ROLLERS

FIELD OF INVENTION

Washing devices for cleaning of paint roller applicators of the type having a fiber or foam coating of natural or synthetic fibers.

BACKGOUND OF INVENTION

Since the advent of fiber covered tubular rollers for the application of paint to various flat surfaces, such as interior walls, the use has extended to amateur and professional painters alike. The rollers make it possible to cover areas to be painted much more rapidly than with a brush, and especially in the hands of amateur painters, the results are much more uniform and satisfactory. The increased use of latex based paints has also provided increased use of paint rollers and this type of paint has the distinct advantage that, until it sets up, it can be washed or diluted with ordinary tap water. Thus, the use of more expensive paint brush cleaners such as turpentine or oil-base paint thinners is unnecessary.

Paint rollers can be cleaned, therefore, of latex paint by a thorough soaking in water if done immediately following the paint application. Cleaning by hand, however, is a messy job and it is difficult to remove paint from the fine openings and interstices of the soft dense fibers used on the roller surfaces.

It is an object of the present invention to provide an apparatus for cleaning latex paint or water soluble paint from roller applicators. It is more specifically an object to provide an apparatus which is essentially automatic in its operation once a paint roller is inserted in a washing chamber. A further object is an apparatus which can clean two paint rollers simultaneously. It is another object to provide an apparatus which is relatively inexpensive and can be avaialble to the average householder for a relatively low price.

Other objects and features of the invention will be apparent in the following description and claims in which the invention is described and details are provided to enable a person skilled in the art to make and use a device in accordance with the invention. The best modes presently contemplated are set forth in the following specification.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

The Invention

The paint roller cleaner includes a housing which carries a mount much the same as is used on a roller holder to mount a paint roller on a first axis for rotation on that axis. This first axis mount may be resiliently swingable and biased in relation to a second axis at which an elongate washer tube is mounted for contact with a paint roller.

A water powered turbine drives the washer tube which delivers water to the paint roller as well as rotating the paint roller and exerting a squeegee action on the fibers of the paint roller. The water which powers the turbine flows to the cleaning area and drains to a suitable outlet. Soap may be added in a metered quantity to assist in the cleaning action and then the roller rinsed when the soap supply is exhausted.

Detailed Description of the Apparatus

Figure 1:
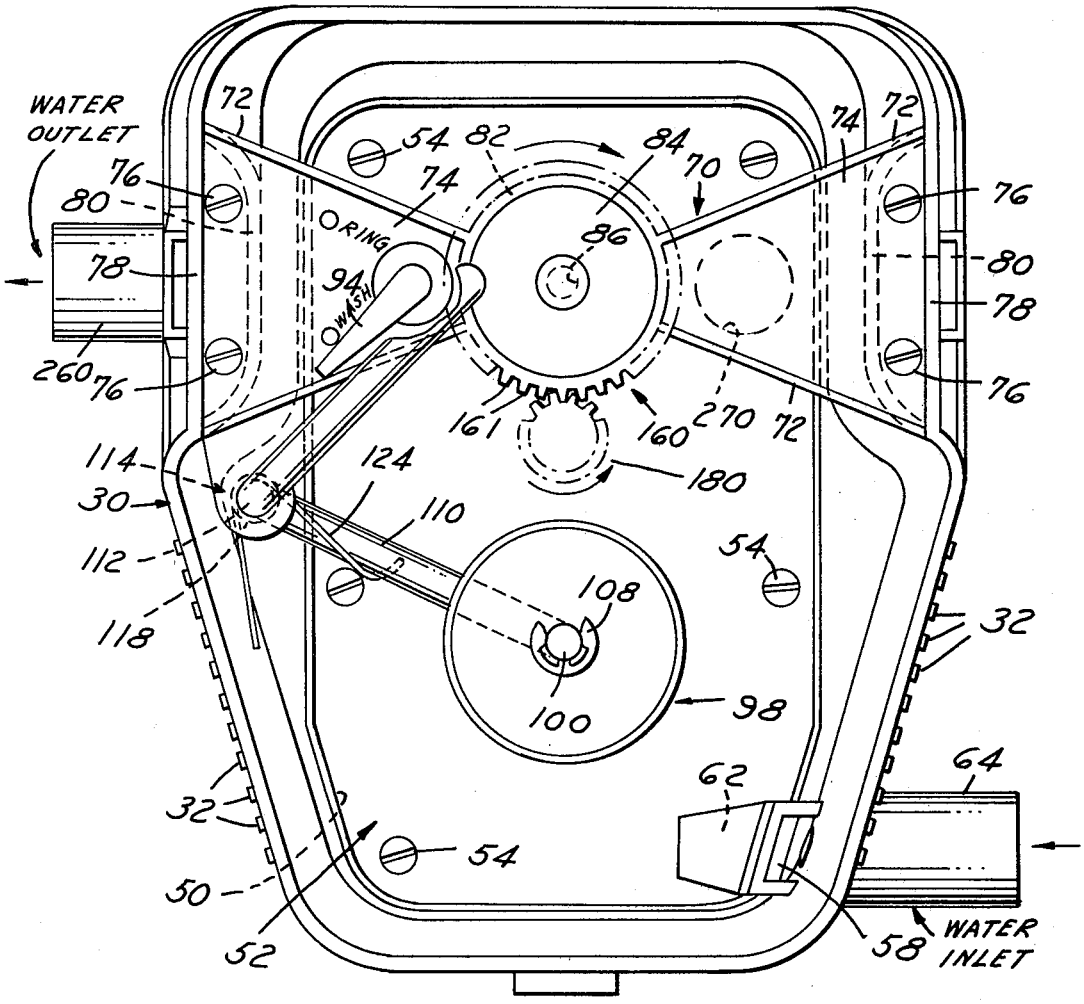
FIG. 1, an end view of a single roller apparatus with the top cover removed.
Figure 3:
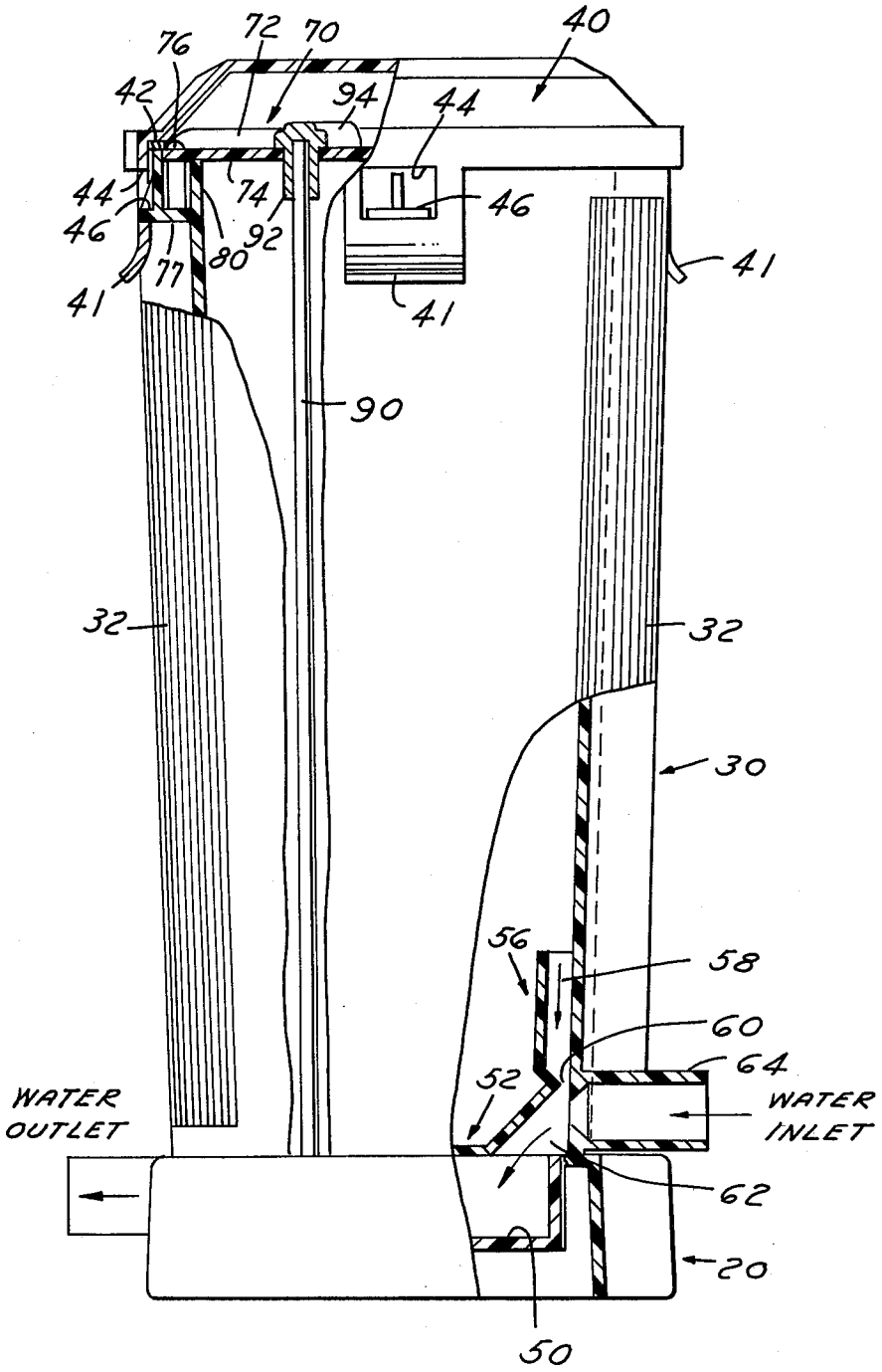
FIG. 3, an end view of a roller cleaner apparatus partially in section.

In FIGS. 1 and 3, a housing for a single roller washer is illustrated consisting of a base 20, an enclosing side wall 30, and a top cover 40. The side wall enclosure 30 is formed with external ribs 32 to provide a decorative exterior as well as to facilitate gripping of the device. The cover 40 has a depending flange tab 41 and carries a sealing gasket 42. The flange tabs are apertured around at 44 to cooperate with snap projections 46 which lock the cover on the side wall 30 when pressed down.

Figure 7:
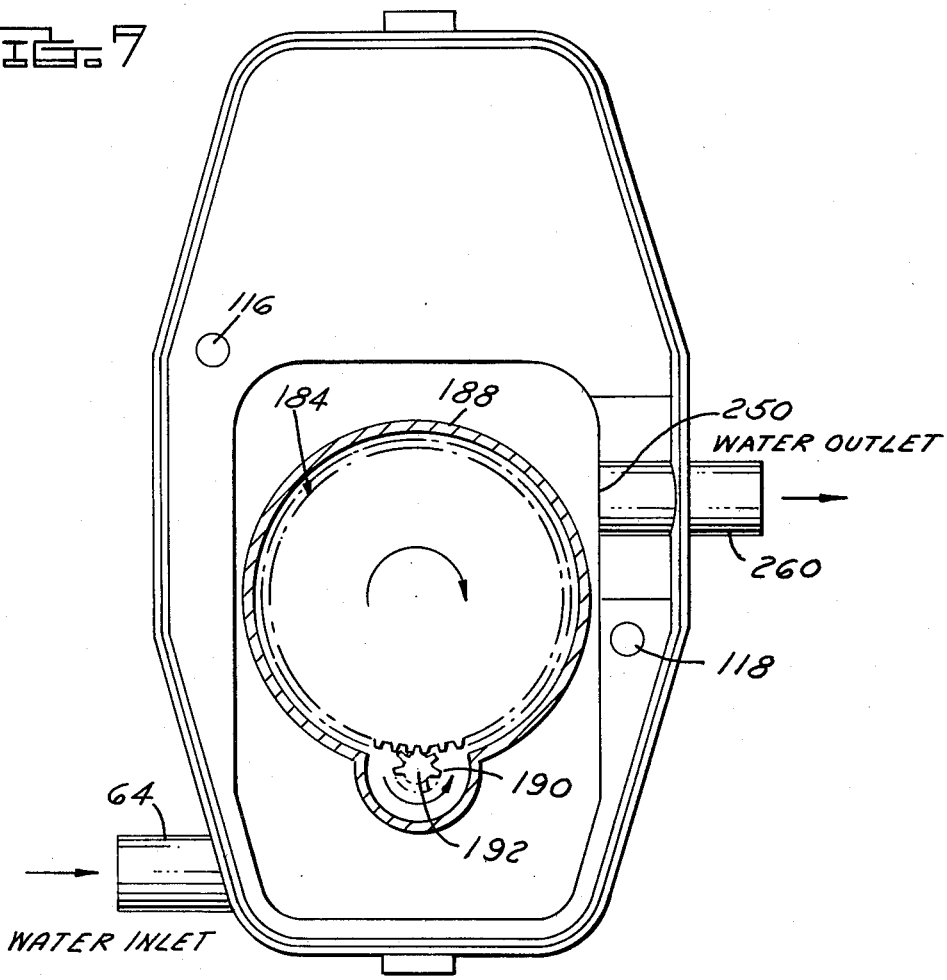
FIG. 7, a bottom view on line 7—7 of FIG. 6.
Figure 5:
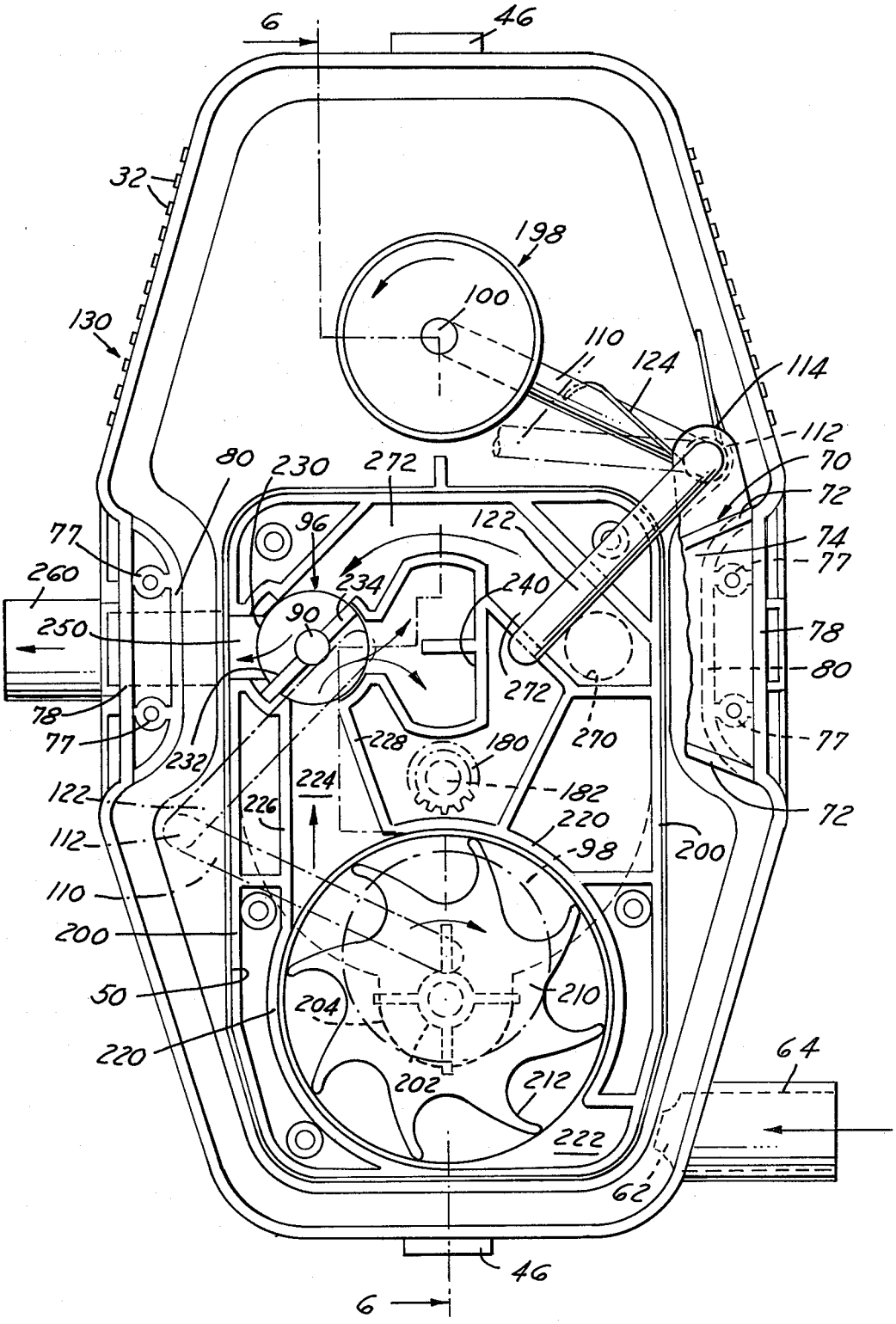
FIG. 5, a plan view of a double roller cleaner with covers removed to reveal working parts.
Figure 6:
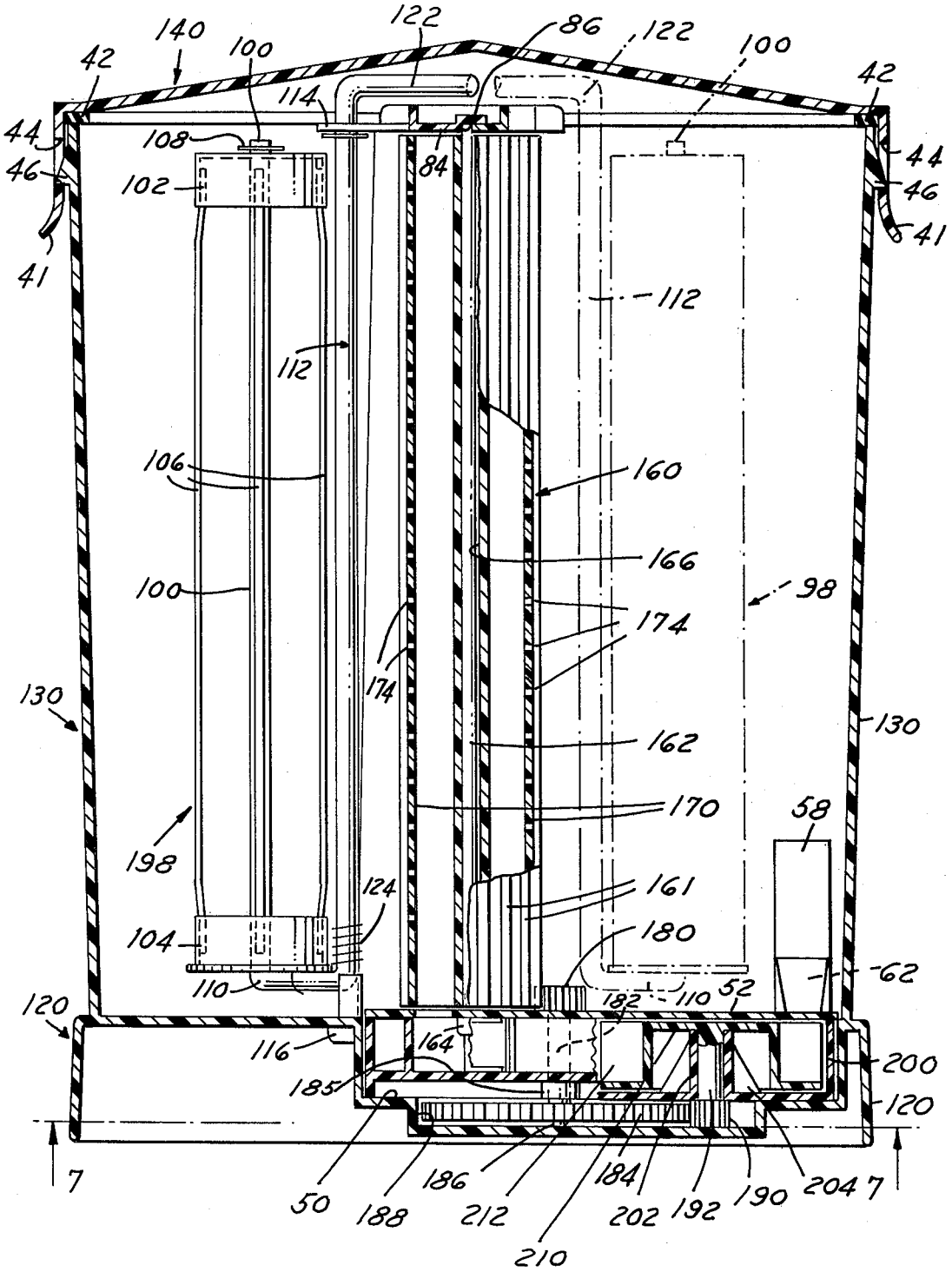
FIG. 6, a vertical section on line 6—6 of FIG. 5.

In FIGS. 5, 6 and 7, a housing for a double roller washer is illustrated having a base 120, a side wall enclosure 130, and a top cover 140. The difference between the two embodiments lies in the mount for two paint rollers which requires that the housing, base, and cover in FIGS. 5, 6 and 7 is wider to accommodate a second roller chamber. FIG. 3 is a proper end view of both the single and double roller embodiments. The cover gasket and the interlock cover flange apertures 44 and snap projections 46 are the same in each embodiment.

The operating mechanism in each embodiment is also the same and will be described in connection with all the figures.

A substantially rectangular chamber 50 with an open top is molded in to the bases 20 and 120 and a tight fitting cover 52 is arranged to be screwed on to the top of the chamber 50 by screws 54. The cover has molded into it a riser 56 (FIG. 3) which forms a soap chamber 58 opening through a restricted throat 60 to a water entry port 62 in communication with a hose attachment nipple 64.

As shown best in FIGS. 1, 3 and partially in FIG. 5, a reinforced cross-member 70 spans the sides of the side wall enclosures 30 and 130. V-shaped side flanges 72 border a double V web plate 74 which is bolted by head bolts or screws 76 to suitable sockets 77 molded into the walls 30 and 130 between a recessed inturn 78 in the wall and an inner connector strip 80. A circular flange 82 with a closing web 84 is supported by the side flanges 72 and side web plates 74 centrally of the unit. A shaft support recess 86 is provided at the center of the web 84.

A valve control shaft 90 is journalled in web 74 through a boss 92 (FIG. 3) on a valve control knob 94, passes through the cover plate 52 and mounts a rotatable gate valve 96 shown in FIGS. 4 and 5 which will be described later.

Roller Mounts and the Mount for Rollers to be Washed

A paint roller usually consists of a mounting tube of plastic or stiff paper or metal which is covered with a pile fabric. The interior of the tube is smooth. The support used for a paint roller is a pair of spaced circular elements to be located at each end of the interior of the roller tube, each journalled for free rotation on the rod or shaft of a roller handle. These end elements are connected by a plurality of parallel resilient wire elements (for example, four) which are disposed parallel to the axis of the mounting shaft forming an elongate cage with an outside diameter just slightly larger than that of the end elements and having a sliding fit with the inside diameter of the roller mounting tube. Thus, the roller will slide on to the wire cage and rotate freely on the mounting shaft. A handle is provided to allow manipulation of the roller.

In FIG. 6, a roller mount, as above described, is shown as an example. A support shaft 100 carries plastic end mounts 102, 104 journalled on the shaft. The end mounts are joined by resilient wires 106 which form the support cage referred to above. A split washer 108 holds the mount on the shaft. The shaft 100 is bent 90° at the bottom to form an arm 110 which in turn is mounted on a continuation of a vertical shaft 112 journalled at the top in an extension 114 of web 74 outside one of the flanges 72. Shaft 112 has an extension at the bottom which is journalled in a suitable socket in the base of the housing. In the bottom view of FIG. 7, these sockets are shown at 116 and 118. A manipulation arm 122 at the top of shaft 112 enables an operator to swing shaft 112 and thus arm 110 away from the center of the unit to permit the mounting and dismounting of paint rollers from the top of the unit. A coiled spring 124 acts on arm 110 to urge the roller mount to the center of the unit toward a cleaning cylinder to be described. In FIG. 1, a single roller mount 98 is provided. In FIGS. 5 and 6, two roller mounts 98 and 198 are provided to receive paint rollers which are to be washed. When the cover of the washer unit is removed, paint rollers may be slipped on and off the wire cage mounts.

The Washing Cylinder and Mechanical Drive

Figure 2:
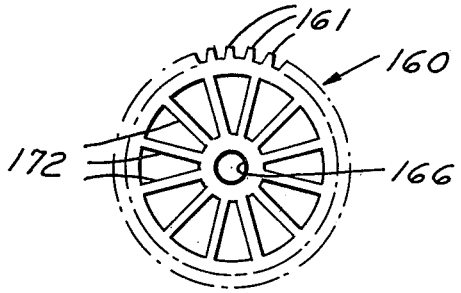
FIG. 2, a plan view of a gear, water jet and squeegee tube.

A washing cylinder generally designated 160 serves as a revolving washing cylinder for the vertically supported rollers. In FIGS. 1 and 2 and 6 this cylinder 160 is shown having external projections such as regularly spaced splines 161 on its outer surface parallel to the axis of rotation of the cylinder which is mounted on a shaft 162 journalled at the top end in a recess 86 in the web 84 of the cross-member 70 and at the bottom end in a journal recess 164 in cover 52 (FIG. 4). Shaft 162 is located in a central bore 166 of the cylinder 160. Sapced outside the central tube, which has the bore 166, is an outer wall 170 supported by spoke-like radial webs 172. The wall 170 is perforated by numerous spaced holes 174 between the spoke webs 172. Thus, the washer cylinder is mounted for rotation on shaft 162. The splines 161 serve as gear teeth and are engaged at the bottom of the cylinder with a spur gear 180.

As shown in FIG. 6, the spur gear 180 is mounted on a vertical shaft 182 journalled in cover 52 and in a tube 185 in a housing 200 to be later referenced. This shaft carries a large coaxial drive gear 184. A thrust bearing 186 in the base of a gear recess is molded into the bottom 120. This flange gear 184 is meshed with and driven by a spur gear 190 mounted on a shaft 192. The rectangular recess 50 in the bottoms 20 and 120 receives a molded mechanism housing 200. A bottom section of this housing carries a boss 202 supported by ribs 204. Shaft 192 is journalled in this boss 202. Mounted on the top of shaft 192 is a bladed turbine 210 with a plurality of hooked blades 212. Thus, rotation of turbine by a suitable fluid stream will drive gears 190, 184 and 180 to rotate the washing cylinder 160.

The Fluid Drive System

The water inlet nipple 64 has been described and this inlet leads to a passage 62 just above the turbine. As shown in FIG. 5, the turbine is housed in circular walls 220 which surround the turbine except for an inlet port 222 and an outlet port 224. The outlet port formed by converging walls 226 and 228 terminates at a gate valve 230 having opposed blades 232 and 234. To the right of gate valve 230 as viewed in FIG. 5 is a chamber 240 directly below the washing cylinder 160. As viewed in FIG. 4, the cover has a V-shaped opening 242 at the bottom and a similar opening 244 at the top. With a single roller washer as in FIG. 2 only the opening 242 is needed. With a double roller washer as in FIG. 6, both openings 242 and 244 would be provided.

Figure 4:
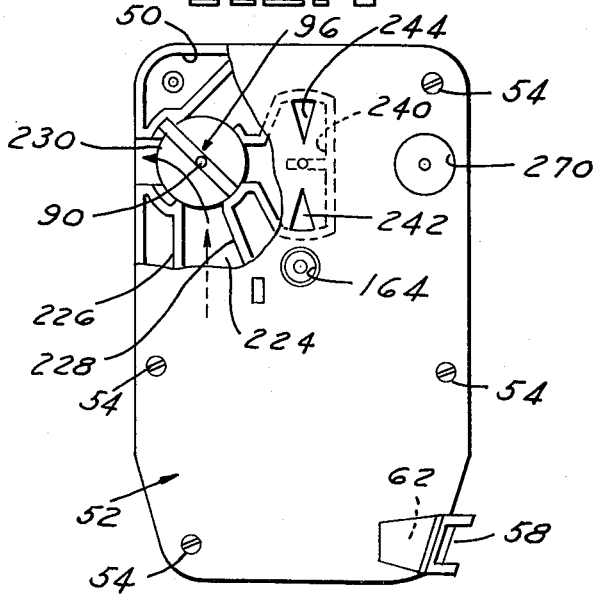
FIG. 4, a plan view of a turbine cover.

As the valve 230 is viewed and positioned in FIG. 4, water will be directed from port 224 to an outlet port 250 and an outlet nipple 260. As the valve 230 is positioned in FIG. 5, the water from turbine outlet port 224 will be directed to chamber 240 and then upward through ports 242 or 242 and 244 to the annular elongate chamber in the washer cylinder 160. The water will be forced out of the holes 174 in radial streams between the splines 161. The V-shaped openings 242 and 244 will align with the V-shaped chambers between the webs or spokes 172 of the washer cylinder and fill each chamber as it moves past the openings.

Operation

When a single roller washer or a double washer is assembled as above described, a water hose can be connected to water inlet nipple 64 in a conventional way. If the device is located outside or in a laundry tub, it is not necessary to connect the outlet nipple to a drain hose.

The cover 40 or 140 is removed and one or two paint rollers which need cleaning can be mounted on the cage supports 98. Then the cover is replaced and water under pressure is admitted to the inlet. This water passes into the down port 62 (FIG. 3) and impacts on the blades 212 of turbine 210. The force of this water will rotate the turbine and in turn the gears 190, 184 and 180. Gear 180 will drive the cylinder 160. The springs 124, which permit the roller cages to be moved away from cylinder 160 in loading and unloading, urge the rollers against the washing cylinder so that the fibers on the rollers are alternately squeezed and released. At the same time during the release phase, water is forcefully directed radially from holes or ports 174 against the rollers. Thus, there is a continuous flooding and squeezing of the fiber of the paint rollers. During this phase, the valve 230 manipulated by lever 94 is in the position shown in FIG. 5.

After the outlet water runs relatively clear, the valve 230 can be shifted to the position shown in FIG. 4. Water will then flow out the outlet and the splines on the cylinder 160 will squeeze the paint roller to squeeze it or ring it, this removing accumulated water on the fibers before the cleaned roller is removed from the container.

A drain hole 270 in cover 52 allows water coming out of the washer cylinder to flow (FIG. 5) through passage 272 past the valve 230 to the outlet 250–260.

The various parts of the apparatus can be formed largely of molded plastic as, for example, the housing formed with the base and side walls. The removable cover can be a molded plastic element, and the cross-member 70 can be a molded plastic member. The mechanism housing 200 can also be a molded plastic element.

What I claim is:

1. A washing apparatus for cleaning paint applicators of the roller type which comprises:

(a) a housing, (b) an elongate rotatable roller mount for a paint roller to be cleaned mounted for rotation on a first axis in said housing, (c) a washer cylinder mounted in said housing for rotation on a second axis parallel to and adjacent said first axis, (d) means to rotate said washer cylinder and said rotatable roller mount simultaneously, and (e) means to direct washing liquid to a paint roller on a roller mount to flush paint from said paint roller, (f) said housing having a base, side walls and a cover at one end, and said means to rotate said washer cylinder comprising a pressure liquid operated turbine mounted in a turbine chamber in said base having an inlet port and outlet port, and a gear train driven by said turbine operatively connected to said washer cylinder to rotate said cylinder in response to introduction of liquid under pressure into said inlet port of said turbine chamber.

2. A paint roller washing apparatus as defined in claim 1 in which said washing cylinder has external splines, and one gear of said gear train is in meshing engagement with said splines.

3. A paint roller washing apparatus as defined in claim 1 in which said base has a liquid outlet port and a washer cylinder liquid chamber each in communication with the outlet port of said turbine chamber, and a valve movable to direct liquid from said turbine chamber outlet port selectively to said washer cylinder liquid chamber and to said liquid outlet port, said washer cylinder liquid chamber being in communication with a paint roller surface through axial and radial passages in said washer cylinder.

4. A paint roller washing apparatus as defined in claim 1 in which means is provided to move said valve manually to each of its selective positions, said means being accessible at the cover end of said housing.

5. A washing apparatus for cleaning paint applicators of the roller type which comprises:

(a) a housing, (b) an elongate rotatable roller mount for a paint roller to be cleaned mounted for rotation on a first axis in said housing, (c) a washer cylinder mounted in said housing for rotation on a second axis parallel to and adjacent said first axis, (d) means independent of said roller mount to rotate said washer cylinder, and (e) means to direct washing liquid to a paint roller on a roller mount to flush paint from said paint roller, (f) said roller mount being movable in a direction transverse to said first and second axes to enable it to be positioned against said washer cylinder, (g) said washer cylinder comprising a cylindrical wall having external projections extending therefrom to contact and engage a paint roller surface to form a driving connection between a mounted roller and said washer cylinder when said washer cylinder is rotated by said independent means.

6. A paint roller washing apparatus as defined in claim 5 in which said washer cylinder has perforate walls to allow liquid to pass from the interior of said cylinder to an adjacent paint roller, and in which said means to rotate said washer cylinder comprises a water actuated turbine operatively connected to said washer cylinder, and means to direct water from said turbine to the interior of said washer cylinder to serve as the washing liquid for said roller.

7. A paint roller washing apparatus as defined in claim 5 in which said cylinder has perforate walls to allow liquid to pass from the interior of said cylinder to an adjacent paint roller.

8. A washing apparatus for cleaning paint applicators of the roller type which comprises:

(a) a housing, (b) an elongate rotatable roller mount for a paint roller to be cleaned mounted for rotation on a first axis in said housing, (c) a washer cylinder mounted in said housing for rotation on a second axis parallel to and adjacent said first axis, (d) means to rotate said washer cylinder and said rotatable roller mount simultaneously, and (e) means to direct washing liquid to a paint roller on a roller mount to flush paint from said paint roller, (f) said housing comprising a base, side walls, and a removable cover, said base having a depressed recess formed therein, and a mechanism housing located in said recess formed with a turbine chamber having an inlet and an outlet port, and outlet opening, a washer cylinder liquid chamber and valve chamber intermediate said liquid chamber and said outlet opening.

9. A paint roller washing apparatus as defined in claim 8 in which a cross-member bridges the side walls adjacent said cover end of said housing, and means in said base and said cross-member to support a shaft on said second axis on which said washer cylinder is rotatably mounted.

10. A washing apparatus for cleaning paint applicators of the roller type which comprises:

(a) a housing, (b) an elongate rotatable roller mount for a paint roller to be cleaned mounted for rotation on a first axis in said housing, (c) a washer cylinder mounted in said housing for rotation on a second axis parallel to and adjacent said first axis, (d) means to rotate said washer cylinder and said rotatable roller mount simultaneously, and (e) means to direct washing liquid to a paint roller on a roller mount to flush paint from said paint roller, (f) said washer cylinder comprising an inner and an outer cylinder connected by radial webs to form axial chambers, said outer cylinder having external projections to engage and impart a rotating motion to an adjacent paint roller, and openings in said outer cylinder for the passage of liquid to an adjacent paint roller, and said means to direct washing liquid to a paint roller comprising a source of liquid under pressure communicating with said axial chamber.

11. A paint roller as defined in claim 10 in which said external projections comprise external splines on said outer cylinder, and said means to rotate said washer cylinder comprises a drive gear meshed with said splines.

12. A washing apparatus for cleaning paint applicators of the roller type which comprises:

(a) a housing, (b) an elongate rotatable roller mount for a paint roller to be cleaned mounted for rotation on a first axis in said housing, (c) a washer cylinder mounted in said housing for rotation on a second axis parallel to and adjacent said first axis, (d) means to rotate said washer cylinder and said rotatable roller mount simultaneously, and (e) means to direct washing liquid to a paint roller on a roller mount to flush paint from said paint roller, (f) said means to rotate said washer cylinder comprising a water turbine housed in a turbine chamber in said housing, said turbine chamber having a water inlet for water under pressure, and a soap chamber in said housing in communication with said water inlet whereby soap will be aspirated into the water stream driving said turbine, and means to direct the water flowing from said turbine chamber to said washer cylinder and to paint rollers mounted on said roller mount.

13. A washing apparatus for cleaning paint applicators of the roller type which comprises:

(a) a housing, (b) an elongate rotatable roller mount for a paint roller to be cleaned mounted for rotation on a first axis in said housing, (c) a washer cylinder mounted in said housing for rotation on a second axis parallel to and adjacent said first axis, (d) means to rotate said washer cylinder and said rotatable roller mount simultaneously, and (e) means to direct washing liquid to a paint roller on a roller mount to flush paint from said paint roller, (f) said roller mount comprising a shaft at said first axis swingably mounted to move transversely to said axes, spring means to bias said shaft in the direction of said washer cylinder, and means accessible at one end of said housing to permit manual movement of said shaft away from said washer cylinder.

* * * * *